United States Patent [19]

Priestly

[11] Patent Number: 4,664,603

[45] Date of Patent: May 12, 1987

[54] PETROLEUM RECOVERY JET PUMP PUMPING SYSTEM

[75] Inventor: Ronald A. Priestly, Longview, Tex.

[73] Assignee: Double R Petroleum Recovery, Inc., Longview, Tex.

[21] Appl. No.: 636,170

[22] Filed: Jul. 31, 1984

[51] Int. Cl.[4] ..... F04F 5/00

[52] U.S. Cl. ..... 417/172; 417/198

[58] Field of Search ..... 417/76, 79, 80, 151, 417/167, 170, 172, 178, 198

[56] References Cited

U.S. PATENT DOCUMENTS

| | | | |
|---|---|---|---|
| 1,992,436 | 2/1935 | McMahon | 417/172 X |
| 2,080,622 | 5/1937 | McMahon | 417/172 X |
| 2,080,623 | 5/1937 | McMahon | 417/172 X |
| 2,080,624 | 5/1937 | McMahon | 417/172 X |
| 2,114,905 | 4/1938 | McMahon | 417/172 X |
| 2,468,642 | 4/1949 | Shallenberg | 417/198 X |
| 2,654,434 | 10/1953 | Culleton | 417/80 X |
| 2,948,233 | 8/1960 | Scharfe | 417/151 X |
| 3,216,368 | 11/1965 | Waldron | 417/172 |
| 3,551,074 | 12/1970 | Stout | 417/172 |
| 4,135,861 | 1/1979 | Brown et al. | 417/172 X |
| 4,183,722 | 1/1980 | Roeder | 417/172 |
| 4,285,638 | 8/1981 | Clark | 417/172 |
| 4,441,861 | 4/1984 | Canalizo | 417/172 |
| 4,504,195 | 3/1985 | Binks et al. | 417/172 |

*Primary Examiner*—Carlton R. Croyle
*Assistant Examiner*—Paul F. Neils

[57] ABSTRACT

A petroleum recovery pumping system comprising an improved jet pump having a nozzle assembly adapted to be selectively and reversibly installed in either an up-flow or down-flow direction, and a shoe adapted to receive and seat the jet pump adjacent to a producing zone within a well bore. The shoe is preferably further adapted to provide fluid communication between the producing zone and a power fluid discharged through a nozzle section within the jet pump. The shoe is preferably further adapted by means of circumferentially spaced, longitudinally extending passageways to provide fluid flow in an axial direction around the jet pump.

3 Claims, 5 Drawing Figures

PETROLEUM RECOVERY JET PUMP PUMPING SYSTEM

TECHNICAL FIELD

This invention relates to a petroleum recovery pumping system, and more particularly, to a recovery system comprising an improved jet pump. One aspect of the invention relates to a jet pump that is particularly effective for producing oil and gas from relatively shallow subterranean wells having low flow rates. A further aspect of the invention relates to a pumping system comprising a jet pump that is particularly well adapted for producing oil and gas from sandy wells and from wells having little or no bottom hole pressure.

BACKGROUND ART

Particular problems have been encountered and particular needs have arisen in producing oil from wells characterized by low flow rates and downhole pressures. Such wells are commonly referred to in the oilfield as "stripper wells," and may produce at rates as low as one or two barrels per day, or less. The conventional method for producing oil from these wells is by the use of surface-mounted pumpjacks that are connected to downhole mechanical rod pumps by strings of sucker rod. The entire string of sucker rod, which extends downward from the surface to the producing formation, is reciprocated several times per minute by the pump jack, which is in turn driven by a motor. In stripper wells, the pump jack is usually operated intermittently on a preset pumping cycle controlled by a time clock.

Unfortunately, the capital outlay required to install a pump jack, drive motor, downhole pump and sucker rod is considerable, and is hard to justify where the potential production is minimal. Furthermore, the operation and maintenance costs for pumpjack installations are expensive. The chances for mechanical failure are great because of the reciprocating action of the pump, which must be transmitted downhole via the string of sucker rod. Whenever maintenance is required, a workover rig is needed in order to pull the string and pump from the hole. In sandy wells, the maintenance problem is particularly severe due to the abrasive action of the sand particles during the reciprocating motion of the pump. Pump cavitation can also be a problem when the gas to liquid ratio is high.

The use of jet pumps for producing liquid and entrained gaseous hydrocarbons from higher volume wells is also well known. Conventional petroleum recovery pumping systems employing jet pumps are commercially available from oil field supply companies such as National Supply Company, the Guiberson Division of Dresser Industries, and the Kobe Division of Baker International Corporation. Patents disclosing the use and operation of jet pumps include, for example, the following U.S. Pat. Nos.: 4,310,288; 2,285,638; 4,135,861; 2,080,623; and 2,041,803.

Generally speaking, jet pumps contain few or no moving parts. A power fluid, usually water or oil, is supplied at high pressure to the nozzle of the jet pump, converting the pressure head into a high velocity jet. Pumping action begins when the fluid in the production inlet chamber is entrained by the jet stream emerging from the nozzle. In the throat, the produced fluid acquires high velocity from the power fluid. This velocity head is subsequently reconverted in a diffuser section to a pressure head having a pressure that is adequate to move the fluid to the surface. Historically, petroleum recovery pumping systems utilizing jet pumps have been primarily recommended for applications involving abrasive or corrosive fluids, applications where the production capacity exceeds that of most reciprocating pumps, and applications where the gas-liquid ratio exceeds the limits for reciprocating pumps.

Although the various commercially available jet pumps utilize differing nozzle and internal flow configurations, they share certain draw-backs and disadvantages which have limited their usefulness for many applications. One principal disadvantage has been that conventional jet pumps have not been effective for wells producing at rates less than about 200 barrels per day. Also, the cost of the conventional, commercially available jet pump installations has heretofore greatly exceeded that which can be justified with low volume wells.

Another disadvantage is that such pumps have required a level of suction fluid within the well that is, for example, about 25% of the distance from the pump location to the surface. Still another disadvantage is that such pumps have typically required a relatively high bottom hole pressure in order to function properly. Because of this, it has heretofore been impossible to take a well to depletion with a jet pump unless the well has an active water drive to maintain the bottomhole pressure at high level.

Thus, although jet pumps are more energy efficient and less susceptible to breakdown and wear than conventional mechanical pumps, their usefulness has been limited by the foregoing disadvantages. A petroleum recovery pumping system is therefore needed that can be effectively and economically operated through use of a jet pump in oil wells having production rates of less than about 100 barrels per day, and as low as one or two barrels a day, with little or no bottomhole pressure.

DISCLOSURE OF INVENTION

According to the present invention, a petroleum recovery pumping system is provided that comprises a jet pump adapted to efficiently and effectively produce petroleum hydrocarbons from wells characterized by low pressures and flow rates. The pumping system desirably uses a surface pump to provide the power fluid, either water or oil, to one or more jet pumps disposed in one or more closely spaced wells. The power fluid is supplied to the nozzle in either an up-flow or down-flow configuration. The nozzle converts the pressure head into a high velocity jet which entrains the pumped fluid as it emerges from the nozzle. In the nozzle throat, the pumped fluid acquires high velocity from the power fluid. This velocity head is then reconverted in the diffuser section of the venturi to a pressure head sufficient to move the fluid to the surface.

The pumping system disclosed herein is useful for economical installation and operation in oil wells having low production rates. According to a preferred embodiment of the invention, a pumping system is provided that is useful for wells having production rates ranging between about one and about 50 barrels per day.

Another advantage of the petroleum recovery pumping system disclosed herein is that it can be used on wells having little or no bottom hole pressure, in shallow wells, or at depths as great as about five thousand feet. The pressure and volume of the surface pumping equipment can be selected to maximize cost effectiveness for various well depths and flow rates.

According to another embodiment of the invention, a petroleum recovery pumping system is provided that comprises a single surface pumping unit which in turn supplies power fluid to one or more different wells, each containing its own jet pump. With this type of installation, petroleum hydrocarbons can be sequentially recovered from a plurality of wells on a regular basis with minimal capital investment and at significantly reduced operating expense when compared to the mechanical pumps that would otherwise be required for wells characterized by low production rates and down-hole pressures.

According to another embodiment of the invention, a petroleum recovery pumping system is provided that comprises a jet pump adapted to be lowered downhole with conventional coil tubing.

According to another embodiment of the invention, a petroleum recovery pumping system is provided that comprises a jet pump adapted to be stabbed into a shoe disposed within a string of production tubing. When stabbed into the shoe, inlet ports in the middle section of the jet pump are preferably situated adjacent to an annulus in the shoe to which production fluid is supplied through a check valve from the well bore. The inlet ports in the middle section of the jet pump direct the production fluid obliquely inward toward the longitudinal bore of the jet pump in the general direction of travel of the power fluid through the bore. The shoe preferably further comprises a plurality of circumferentially spaced axial bores adapted to provide fluid communication between a section of production tubing disposed below the shoe and the production tubing above the shoe. These axially extending passageways are desirable for transporting power fluid down through the tubing whenever the jet pump is to be used in an up-flow configuration, and for transporting the combined power and production fluid upwardly through the tubing around the pump whenever the pump is used in a down-flow configuration.

According to another embodiment of the invention, an improved jet pump is provided that comprises coaxially aligned, threadedly connected top, middle and bottom sections, each having a centrally disposed longitudinal bore adapted to provide fluid communication between the sections. The middle section is preferably adapted to be reversible, meaning that the threads at each end of the middle section are adapted to threadedly engage the threads of either the top or bottom section. A nozzle section is adapted to be inserted between the middle section and either the top or bottom section, depending upon the desired direction of flow. The nozzle section is adapted to slidably engage the longitudinal bore within either the top or bottom section and to abut a shoulder within the middle section whenever the threads coupling the two sections are tightened. Similarly, a venturi section is adapted to slidably engage either the top or bottom section and to also abut a shoulder within the middle section whenever the threads on the end of the middle section opposite the nozzle section are tightened. When the jet pump is assembled in a downflow configuration, the nozzle section is disposed between the middle section and the top section. Whenever the jet pump is assembled in an up-flow configuration, the nozzle section is disposed between the middle section and the bottom section. Side inlet ports in the middle section are obliquely directed into a frusto-conical counterbore within the middle section to assist the production fluid in combining with the power fluid as the power fluid exits the head of the nozzle section and moves toward the venturi section.

The jet pump of the pumping system disclosed herein contains no moving parts, needs no lubrication, requires a minimum of maintenance, has a longer service life, and is easily installed and recovered. The subject jet pump is very tolerant of corrosive and abrasive fluids, and is particularly effective for producing oil from low volume or problem wells. Furthermore, the high suction produced by the jet pump of the subject pumping system can increase the flow rate on low volume wells. Other objects and advantages of the invention will be apparent to those of ordinary skill in the art upon reading the detailed description with reference to the accompanying drawings.

BRIEF DESCRIPTION OF THE DRAWINGS

The apparatus of the invention is further described and explained in relation to the following drawings wherein.

Like numerals are used to indicate like parts in all figures of the drawings.

DETAILED DESCRIPTION

Figure 1:
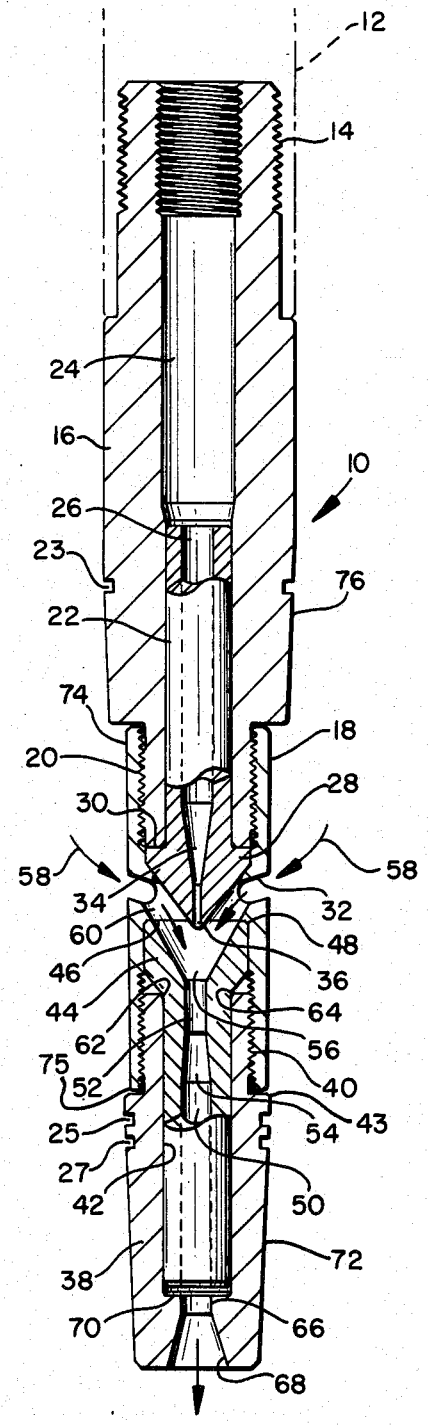
FIG. 1 is a sectional elevation view depicting the jet pump of the invention assembled in a downflow configuration.
Figure 2:
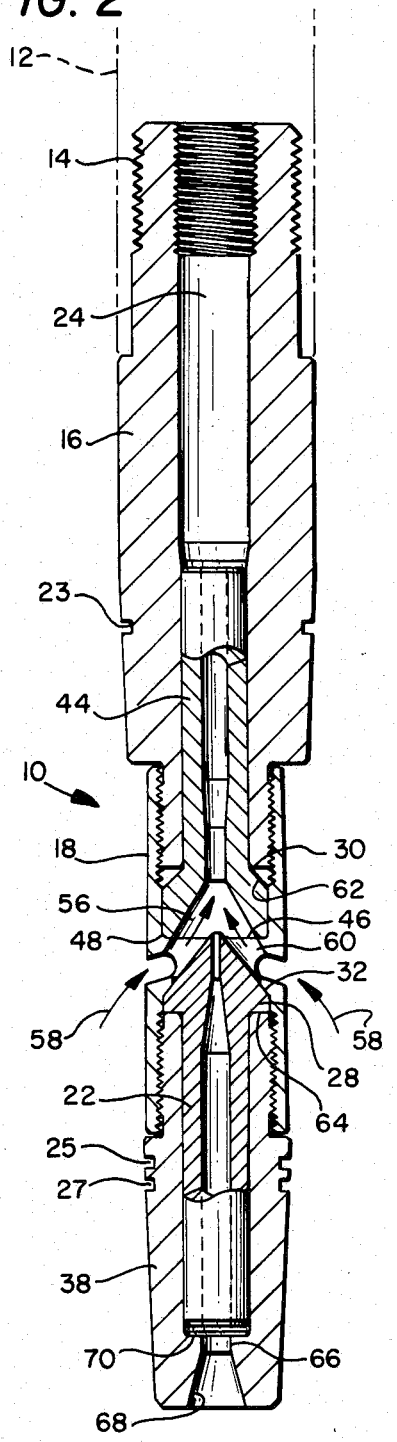
FIG. 2 is a sectional elevation view depicting the jet pump of the invention assembled in an up-flow configuration.

Referring to FIGS. 1 and 2, jet pump 10 is coupled to tubing 12 by means of external threads 14. Internal threads 15 are also provided for use in coupling jet pump 10 to conventional small diameter coil tubing where desired. Jet pump 10 of the invention preferably further comprises threadedly coupled top, middle and bottom sections 16, 18, 38 having nozzle section 22 and venturi section 44 disposed therein. In FIG. 1, top section 16 and middle section 18 are coupled by threads 20. Top section 16 comprises centrally disposed, stepped longitudinal bore 24, the narrower portion of which is adapted to receive nozzle section 22 in sliding engagement therewith. Nozzle section 22 further comprises a centrally disposed, longitudinal bore 26 that is coaxially aligned with longitudinal bore 24 of top section 16. As shown in FIG. 1, nozzle section 22 further comprises head 28 that is maintained in fixed relation to top section 16 by shoulder 30 and to middle section 18 by shoulder 32 as top section 16 and middle section 18 are brought into sealing engagement by threads 20. Longitudinal bore 26 of nozzle section 22 further comprises inwardly tapered section 34 in which the bore diameter is reduced to that of throat section 36. Annular groove 23 around top section 16 and annular grooves 25, 27 around bottom section 38 are provided as seats for O-rings 98, 120, 121, as hereinafter described in relation to FIG. 3.

According to a preferred embodiment of the invention, the length of tapered section 34 is approximately twice the length and ten times the diameter of throat section 36. Nozzle section 22 is preferably constructed from carborundum so as to resist being abraded by particulate matter such as sand that may be entrained by or suspended in the power fluid. In applications where abrasion is a more significant problem, diamond dust can also be utilized to minimize abrasion to the internal surfaces of nozzle section 22.

Figure 3:
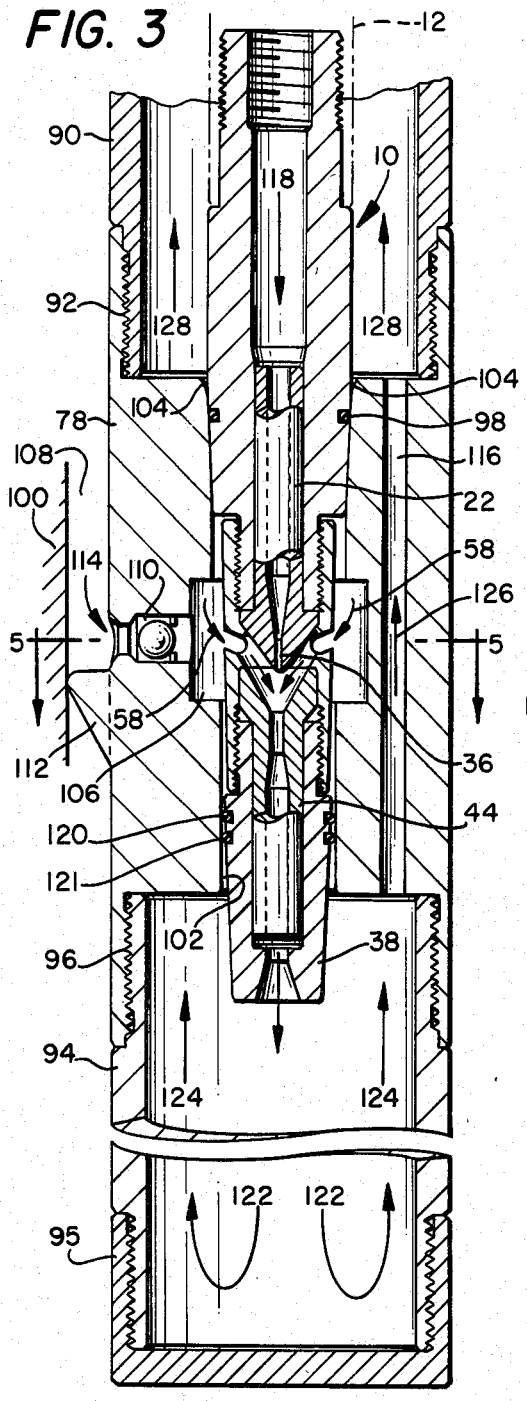
FIG. 3 is a sectional elevation view depicting the jet pump of FIG. 1 installed within a well bore.

Middle section 18 is coupled to bottom section 38 of jet pump 10 by threads 40. Centrally disposed longitudinal bore 42 of bottom section 38 is adapted to receive and slidably engage venturi section 44. As threads 40 are tightened, top edge 46 of venturi section 44 is brought into abutting engagement with corner 48 of middle section 18. Venturi section 44 further comprises a centrally disposed longitudinal bore having a first cylindrical section 50 that communicates with a smaller diameter cylindrical section 52 through tapered section 54. The top portion of venturi section 44 further comprises frusto-conical counterbore 56 which cooperates with frusto-conical counterbore 60 of middle section 18 to promote smooth fluid flow between inlet ports 58 of middle section 18 and small diameter cylindrical section 52 of venturi section 44. Beveled surface 62 of venturi section 44 and shoulder 64 of bottom section 38, respectively, cooperate in bringing venturi section 44 into the proper positional alignment as threads 40 are tightened. According to a preferred embodiment of the invention, the lengths of tapered section 54, small diameter section 52 and frusto-conical section 56 of venturi section 44 are approximately equal. Cylindrical bore 42 of bottom section 38 is stepped inwardly to form cylindrical section 66 that is adapted to provide fluid communication between longitudinal bore 50 of venturi section 44 and frusto-conical counterbore 68 of bottom section 38. Shoulder 70 of bottom section 38 abuts and seats the bottom end of venturi section 44. Outside wall 72 of bottom section 38 and the lower extending portion of outside wall 76 of top section 16 are preferably cooperatively tapered to facilitate the engagement of jet pump 10 with shoe 78 as shown in FIG. 3. This downwardly extending and inwardly tapered section of jet pump 10 is also sometimes collectively referred to as the "stinger."Middle section 18 is preferably constructed in such manner that its outside diameter at corner 75 does not exceed the diameter of bottom section 38 at corner 43 for reasons that are discussed more fully below in relation to FIG. 2.

As shown in FIG. 1, jet pump 10 is assembled in a down-flow configuration, meaning that the power fluid is forced downward from a surface pump (not shown) through tubing 12 into longitudinal bore 24 of top section 16 of jet pump 10. The power fluid is thereafter directed downward through longitudinal bore 26, tapered section 34 and throat 36 of nozzle section 22. As the power fluid is forced through the progressively smaller diameter bore of top section 16 and nozzle section 22, finally exiting through throat 36, the pressure head exerted by the surface pump and the column of power fluid within tubing 12 is converted to a velocity head. Upon exiting throat 36 of nozzle section 22, the power fluid is directed through frusto-conical section 56 of venturi section 44 into small diameter section 52, and subsequently, through the progressively larger diameter bores of venturi section 44 and bottom section 38 of jet pump 10. As the power fluid passes from throat 36 of nozzle section 22 into small diameter section 52 of venturi section 44, it draws production fluid inward through oblique inlet ports 58 of middle section 18. As shown in FIG. 1, inlet ports 58 are preferably inclined so as to feed the production fluid into frusto-conical counterbore 60 of middle section 18 in a direction that is concurrent with the fluid flow exiting throat 36 of nozzle 22. As the combined fluids pass through the increasingly larger diameter bores of venturi section 44 and bottom section 38, the velocity head of the combined fluids is again converted to a pressure head. The operation of jet pump 10 in the down-flow configuration is further explained in relation to FIG. 3 below.

In FIG. 2, jet pump 10 is assembled in an up-flow configuration. In the up-flow configuration, middle section 18 and the positions of nozzle section 22 and venturi section 44 are reversed. To accommodate this reversal, top section 16, middle section 18 and bottom section 38 are constructed in such manner that venturi section 44 will slidably engage the longitudinal bore of top section 16 and that nozzle section 22 will slidably engage the longitudinal bore of bottom section 38. Middle section 18 is also reversed so that frusto-conical counterbore 60 will still mate with frusto-conical counterbore 56 of venturi section 44, and so that inlet ports 58 will still direct fluid into frusto-conical counterbore 60 in a direction that is cocurrent with the fluid flow exiting throat 36 of nozzle 22. In the up-flow configuration, head 28 of nozzle section 22 is maintained in fixed relation to bottom section 38 by shoulder 64 and to middle section 18 by shoulder 32 as bottom section 38 and middle section 18 are brought into threaded engagement. Venturi section 44 is maintained in fixed relation to top section 16 by shoulder 30 and to middle section 18 by corner 48 as top section 16 and middle section 18 are brought into threaded engagement. The method of operation of jet pump 10 in the down-flow and upflow configurations, respectively, is further described in relation to FIGS. 3 and 4 below.

FIG. 3 depicts the manner in which jet pump 10 of FIG. 1 is employed in a down-flow configuration within a well. As shown in FIG. 3, jet pump 10 is stabbed into and seated against shoe 78. The upper end of shoe 78 is coupled to production tubing 90 by threads 92. The lower end of shoe 78 is coupled to pipe section 94 by threads 96. Pipe section 94 is preferably sealed at its lower end by cap 95. Pipe section 94 is provided to minimize turbulence while simultaneously reversing the direction of flow of the fluid discharged into it. Shoe 78, production tubing 90 and pipe section 94 are all preferably disposed within casing 100, most of which has been broken away for clarity of illustration.

Referring to FIG. 3, shoe 78 further comprises centrally disposed longitudinal bore 102 adapted by means of chamfer 104 at its upper end to receive and seat the downward extending, tapered end portion of jet pump 10. O-rings 98, 120, 121 are provided to assist in preventing fluid bypass along the annulus between shoe 78 and top and bottom sections 16, 38 of jet pump 10. Bore 102 further comprises annular intake chamber 106, which provides fluid communication between annular space 108 inside casing 100 and inlet ports 58 of jet pump 10 through check valve 110. Shoe 78 further comprises an outwardly extending wall guard 112 which prevents inlet 114 to check valve 110 from being pressed against the inside wall of casing 100, thereby impeding fluid flow into annular intake chamber 106.

Figure 5:
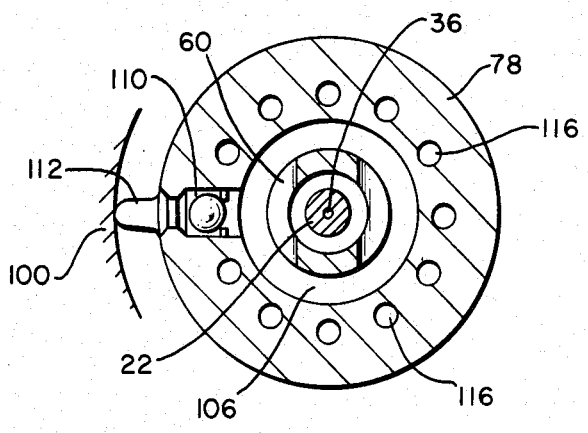
FIG. 5 is a sectional plan view taken along line 5—5 of FIG. 3.

Shoe 78 preferably further comprises a plurality of circumferentially spaced, longitudinal passageways 116 that are adapted to provide fluid communication in a vertical direction between the interior of production tubing 90 and the interior of pipe section 94. Circumferentially spaced, longitudinal passageways 116 are further depicted in FIG. 5, which is a sectional plan view taken along line 5—5 of FIG. 3. Although the number, spacing and diameter of longitudinal passageways 116 can vary within the scope of the invention, the combined cross sectional area of longitudinal passageways 116 should preferably be great enough to accommodate the flow of the power fluid and production fluid combined.

When jet pump 10 is installed as shown in FIG. 3, production tubing 90, shoe 78 and pipe section 94 are preferably suspended at the desired production depth within casing 100. The production fluid enters casing 100 through appropriate perforations (not shown) and fills the annular space between casing 100 and production tubing 90. Power fluid is then injected downward from the surface through the bore of jet pump 10 as shown by arrow 118. As the power fluid passes through throat 36 of nozzle section 22, production fluid is sucked inwardly through inlet ports 58 and downwardly through venturi section 44 together with the power fluid. Upon exiting the lower end of bottom section 38 of jet pump 10, the combined power fluid and production fluid are directed downwardly into pipe section 94. During operation of jet pump 10, pipe section 94 will remain filled with fluid, which will reduce turbulence within pipe section 94 as the direction of flow of the combined power and production fluid is reversed as shown by arrows 122. The combined fluids are thereafter directed upwardly through circumferentially spaced longitudinal bores 116 in shoe 78 into the annular space between jet pump 10 and production tubing 90 above shoe 78 as shown by streamlines 124, 126 and 128, respectively. The pressure head created from the velocity head as the combined fluids emerge from bottom section 38 of jet pump 10 is sufficient to transport both the spent power fluid and the production fluid to the surface.

Figure 4:
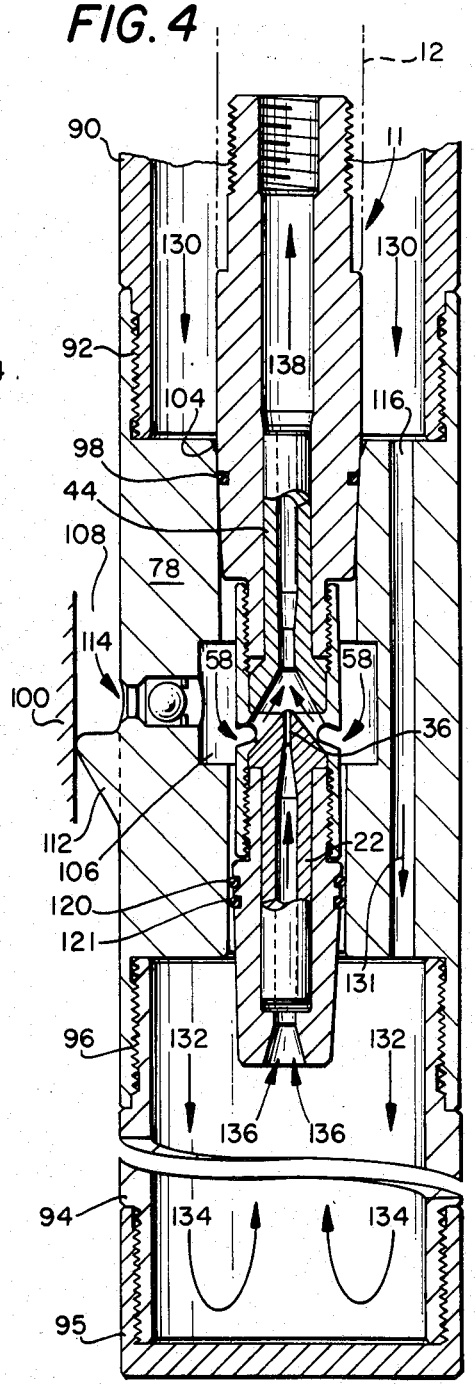
FIG. 4 is a sectional elevation view depicting the jet pump of FIG. 2 installed in a well bore.

Referring to FIG. 4, the flow pattern is reversed whenever jet pump 10, which has an up-flow configuration, is employed. Referring to FIG. 4, power fluid is pumped downwardly through the annulus between production tubing 90 and jet pump 10 as shown by streamlines 130. The power fluid then moves downwardly through circumferentially spaced, longitudinal bores 116 of shoe 78. Upon exiting longitudinal bores 116 as shown by streamlines 131, 132, the power fluid is directed downwardly into pipe section 94, which reverses the direction of flow as shown by arrows 134 and 136, respectively. The power fluid is then directed upwardly through throat 36 of nozzle section 22. As the power fluid enters venturi section 44, production fluid is drawn inwardly through inlet ports 58 from intake chamber 106, which is again in fluid communication with inlet port 114 of shoe 78. The combined power and production fluids are thereafter transported upwardly to the surface through tubing 12 as shown by arrow 138. The upflow configuration of jet pump 10 is preferably employed with low gravity oil or whenever there is very heavy sand.

The petroleum recovery system disclosed herein has proved to be a significantly more efficient and less expensive apparatus than the conventional pump jacks for recovering petroleum hydrocarbons from stripper wells. Furthermore, the apparatus disclosed herein has been used effectively in wells where the conventional, commercially available jet pumps were not useful. According to a preferred embodiment of the invention, jet pump 10 has an overall length of about seven inches, compared to lengths that are an order of magnitude greater for the conventional jet pumps. It is for this reason that jet pump 10 of the invention can be lowered into the well and operated with conventional coil tubing. The petroleum recovery system of the invention does not require the use of a packer, and does not require pumping fluid either up or down the casing.

In one well where the apparatus of the invention was substituted for a conventional pump jack that had been utilized previously, a significant production gain was also achieved. When utilizing the pump jack, the well produced one barrel of oil in about twelve hours of pumping per day. In contrast, when utilizing the petroleum recovery pumping system of the invention, production in the same well was increased to about two barrels per day during three forty-five minute pumping cycles.

In another situation, a single petroleum recovery pumping system was installed for pumping seven wells where seven individual pump jacks had previously been required. This system comprised one service pump that was adapted to alternately pump from each of the seven wells according to a preset time cycle. Each well contained a single jet pump 10 as disclosed herein. Using the pumping system of the invention, utility costs for pumping the seven wells were reduced from $635.00 to $116.00, with no loss of production. Furthermore, the capital costs and maintenance costs required for the pumping system of the invention are significantly lower than for a conventional system.

Other alterations and modifications of the invention will become apparent to one of ordinary skill in the art upon reading the present disclosure, and it is intended that the scope of the present invention be limited only by the appended claims.

What is claimed is:

1. A jet pump comprising coaxially aligned, threadedly connected top, middle and bottom sections, each having a centrally disposed longitudinal bore adapted to provide fluid communication through said sections, a nozzle section adapted to be selectively inserted between said top section and said middle section or between said middle section and said bottom section, said nozzle section being adapted to slidably engage the longitudinal bore of said top section or said bottom section and to abut a shoulder within said middle section whenever the threads coupling said middle section to said top section or to said bottom section are tightened, a venturi section adapted to abut a shoulder within said middle section that is opposite said nozzle section and to slidably engage the longitudinal bore of the adjacent section of said top section or said bottom section whenever the threads connecting said middle section to said adjacent section are tightened; said middle section further comprising obliquely extending inlet ports adapted to provide fluid communication between the circumference of said middle section and the longitudinal bore through said middle section; the outwardly facing surface of said jet pump being inwardly tapered in the downward direction.

2. The jet pump of claim 1 wherein said top section and said bottom section further comprise outwardly facing annular grooves having sealing means disposed therein to control fluid flow in the axial direction along the outside surface of said top and bottom sections when said jet pump is installed in a well bore.

3. A petroleum recovery pumping system comprising:

a. a first conduit disposed in a well bore and adapted to provide fluid communication between a producing zone within the well bore and the surface above it;

b. a shoe coupled to the bottom of said first conduit, said shoe being adapted by means of a centrally disposed longitudinal bore to receive and seat a jet pump lowered through said first conduit from the surface; said shoe further comprising an annular space around said longitudinal bore, a radially extending channel providing fluid communication between said annular space and said well bore, a check valve disposed within said radially extending channel, said check valve being adapted to prevent fluid flow radially outward from said annular space into said well bore, and a plurality of circumferentially spaced passageways extending longitudinally through said shoe around said longitudinal bore outwardly of said annular space;

c. a second conduit coupled to the bottom of said shoe, said second conduit being relatively shorter than said first conduit and being capped at the end opposite said shoe, and said second conduit being in fluid communication with said first conduit through said shoe;

d. a jet pump comprising coaxially aligned, threadedly connected top, middle and bottom sections, each having a centrally disposed longitudinal bore adapted to provide fluid communication through said sections, a nozzle section adapted to be selectively inserted between said top section and said middle section or between said middle section and said bottom section; said nozzle section being adapted to slidably engage the longitudinal bore of said top section or said bottom section and to abut a shoulder within said middle section whenever the threads coupling said middle section to said top section or to said bottom section are tightened; a venturi section adapted to abut a shoulder within said middle section opposite said nozzle section and to slidably engage the longitudinal bore of said top section or said bottom section whenever the threads connecting said middle section to said top section or said bottom section are tightened; said middle section further comprising obliquely extending inlet ports adapted to provide fluid communication between the circumference of said middle section and the longitudinal bore through said middle section cocurrently with the flow discharged from said nozzle section; the outwardly facing surface of said jet pump being inwardly tapered in the downward direction to permit said jet pump to be received into the longitudinal bore of said shoe sufficiently for said inlet ports of said middle section to be brought into fluid communication with the annular space of said shoe, the outer diameter of the uppermost portion of said top section being sufficient to cause said top section to seat against said shoe; said top section and said bottom section further comprising outwardly facing annular grooves having sealing means disposed therein to prevent fluid communication between said annular space in said shoe and said first and second conduits; and e. a third conduit coupled to the top section of said jet pump that is adapted to lower said jet pump inside said first conduit until said jet pump is seated in said shoe and thereafter to provide fluid communication between the longitudinal bores of said top, middle and bottom sections of said jet pump and the surface above said well bore.

* * * * *